US009725137B2

(12) United States Patent
Rijken

(10) Patent No.: US 9,725,137 B2
(45) Date of Patent: Aug. 8, 2017

(54) SEMISUBMERSIBLE WITH FIVE-SIDED COLUMNS

(75) Inventor: Oriol R. Rijken, Houston, TX (US)

(73) Assignee: Seahorse Equipment Corp., Houston, TX (US)

( * ) Notice: Subject to any disclaimer, the term of this patent is extended or adjusted under 35 U.S.C. 154(b) by 900 days.

(21) Appl. No.: 13/107,596

(22) Filed: May 13, 2011

(65) Prior Publication Data

US 2012/0285361 A1 Nov. 15, 2012

(51) Int. Cl.

| | |
|---|---|
| ***B65D 88/78*** | (2006.01) |
| ***B63B 35/44*** | (2006.01) |
| ***B63B 21/50*** | (2006.01) |
| ***B63B 1/10*** | (2006.01) |
| *B63B 1/12* | (2006.01) |

(52) U.S. Cl.

CPC ..... *B63B 21/50* (2013.01); *B63B 1/107* (2013.01); *B63B 35/4413* (2013.01); *B63B 2001/128* (2013.01)

(58) Field of Classification Search

CPC ..... B63B 21/50; B63B 2021/50; B63B 35/00; B63B 35/34; B63B 35/38; B63B 35/44; B63B 35/4413; B63B 2035/00; B63B 2035/44; B63B 1/107; B63B 2001/128

USPC ..... 114/256, 257, 258–267; 405/223.1, 224

See application file for complete search history.

(56) References Cited

U.S. PATENT DOCUMENTS

| | | | | |
|---|---|---|---|---|
| 4,226,555 | A * | 10/1980 | Bourne et al. | 405/224 |
| 4,913,238 | A * | 4/1990 | Danazcko et al. | 405/223.1 |
| 6,447,208 | B1 * | 9/2002 | Huang et al. | 405/224 |
| 7,140,317 | B2 * | 11/2006 | Wybro et al. | 114/264 |
| 7,240,633 | B2 * | 7/2007 | Barlow | 114/200 |

OTHER PUBLICATIONS http://wiki.seasteading.org/index.php/Semi-submersible; Jan. 7, 2014.*

Elements of Ocean Engineering (section Compliant Structures, Tension Leg Platform, p. 54); Society of Naval Architects and Marine Engineers, 1997.*

"Exmar Offshore Floating Production—OPTI-EX," Obtained from http://www.exmaroffshore.com/floating_prod_optiex.html, Date retrieved Feb. 21, 2014, 2 pages.

* cited by examiner

*Primary Examiner* — Daniel V Venne

(74) *Attorney, Agent, or Firm* — Blank Rome LLP

(57) ABSTRACT

A semi-submersible vessel comprises pontoons having a generally five-sided transverse cross section. In the case of a 4-sided semi-submersible, the columns may be arranged in a generally rectangular form with a column at each corner of the rectangular form, each column having with four sides disposed at a right angle to at least one adjacent side and a fifth side on the exterior of the generally rectangular form disposed at 45 degrees to each adjacent side.

6 Claims, 6 Drawing Sheets

SEMISUBMERSIBLE WITH FIVE-SIDED COLUMNS

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

1. Field of the Invention

This invention relates to floating vessels. More particularly, it relates to platform-type semisubmersible vessels 2. Description of the Related Art Including Information Disclosed Under 37 CFR 1.97 and 1.98

A semi-submersible is a particular type of floating vessel that is supported primarily on large pontoon-like structures submerged below the sea surface. The operating decks are typically elevated about 100 or more feet above the pontoons on steel columns. This design has the advantage of submerging most of the area of the components in contact with the sea and minimizing loading from waves and wind. Semisubmersibles can operate in a wide range of water depths, including deep water. They are usually anchored with six to twelve anchors tethered by chains and/or wire cables, which are computer controlled to maintain station-keeping. Semi-submersibles (or "semis") can be used for drilling, workover operations, and production platforms, depending on the equipment with which they are equipped. When fitted with a drilling package, they may be called semisubmersible drilling rigs.

As shown in FIG. 1, a semi-submersible hull 100 of the prior art commonly has columns 102 at the corners of the vessel that are rectangular in cross section. Each column is attached to two pontoons 104 which extend between adjacent columns. Central opening 106 is defined by pontoons 104. Typically, a deck (not shown) is support on upper surface 108 of columns 102.

Certain semi-submersibles of the prior art have columns that are rectangular (four faces per column) and are positioned such that the column faces (sides) are set at 45 degrees with respect to the longitudinal axis of the adjoining pontoon.

The column shape of the present invention is similar to that of the "EXMAR OPTI-EX" semi-submersible illustrated in FIG. 2. However, in the case of that semi-submersible, the non-orthogonal fifth-face of each column is oriented towards the interior of the semi-submersible rather than the exterior.

BRIEF SUMMARY OF THE INVENTION

The present invention relates to the shape of each of the columns on a semi submersible. In a 4-column semi-submersible according to the invention, each of the four columns has five faces, four of the five faces are perpendicular to at least one adjacent face. The fifth face is the outermost face of the column. The angle between the fifth face and the longitudinal axis of an adjacent pontoon is preferably about 45 degrees.

The column configuration of the invention is a variant of the existing deep draft semi submersible configuration used for the dry tree semi submersible vessels Independence Hub and Thunder Hawk which operate in the Gulf of Mexico.

BRIEF DESCRIPTION OF THE SEVERAL VIEWS OF THE DRAWING(S)

FIG. 1 is a dimensioned perspective drawing of a semi-submersible hull of the prior art having rectangular columns.

FIG. 2 contains perspective views from above and below of a semi-submersible vessel of the prior art having 5-sided columns.

DETAILED DESCRIPTION OF THE INVENTION

Figure 1:
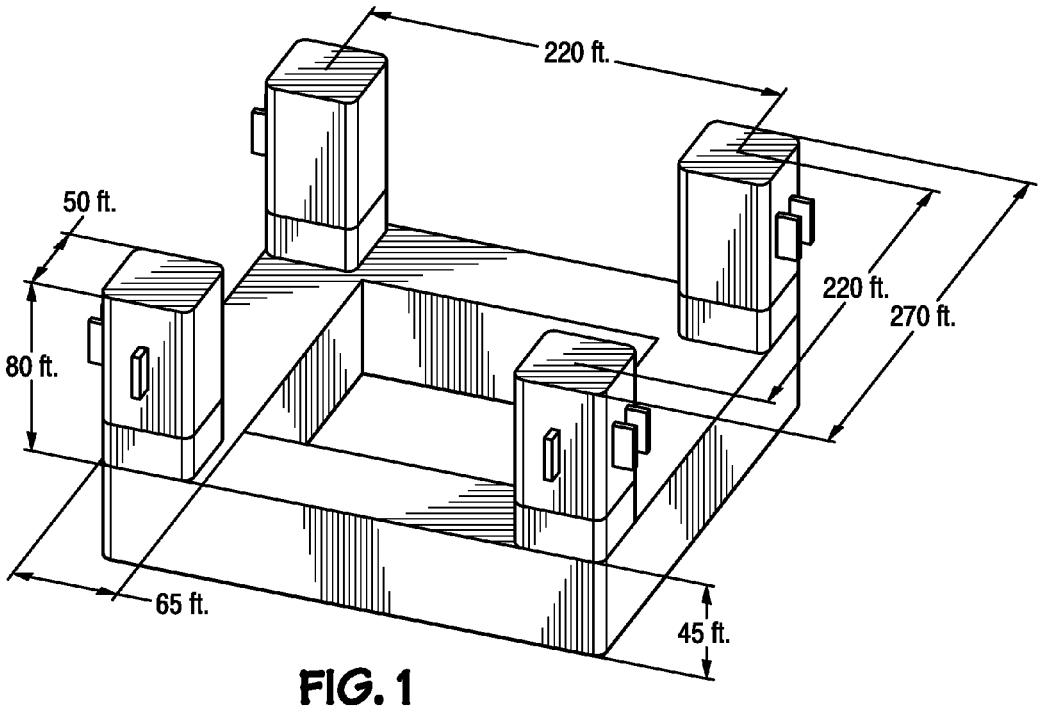
FIG. 1 (PRIOR ART)

The invention may best be understood by reference to certain illustrative embodiments which are shown in the drawing figures.

Figure 3:
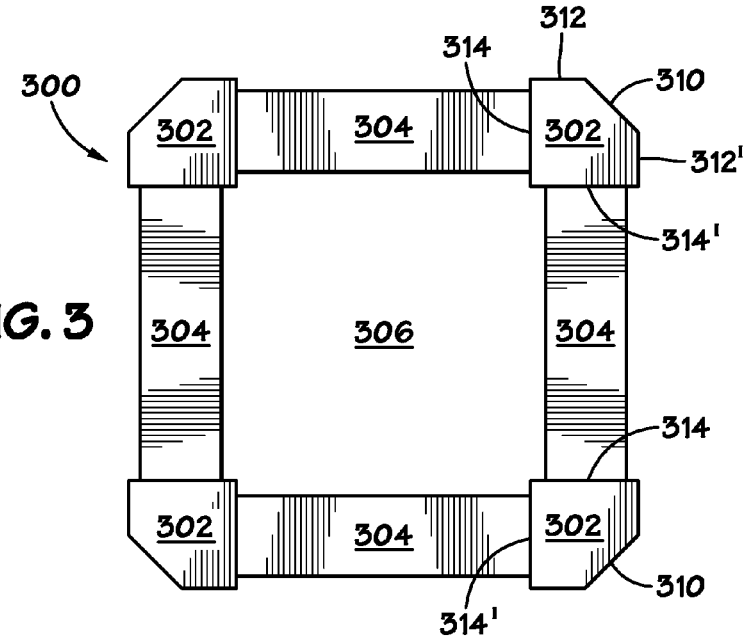
FIG. 3 is a top plan view of a five-sided column semi-submersible according to one embodiment of the invention.
Figure 2A:
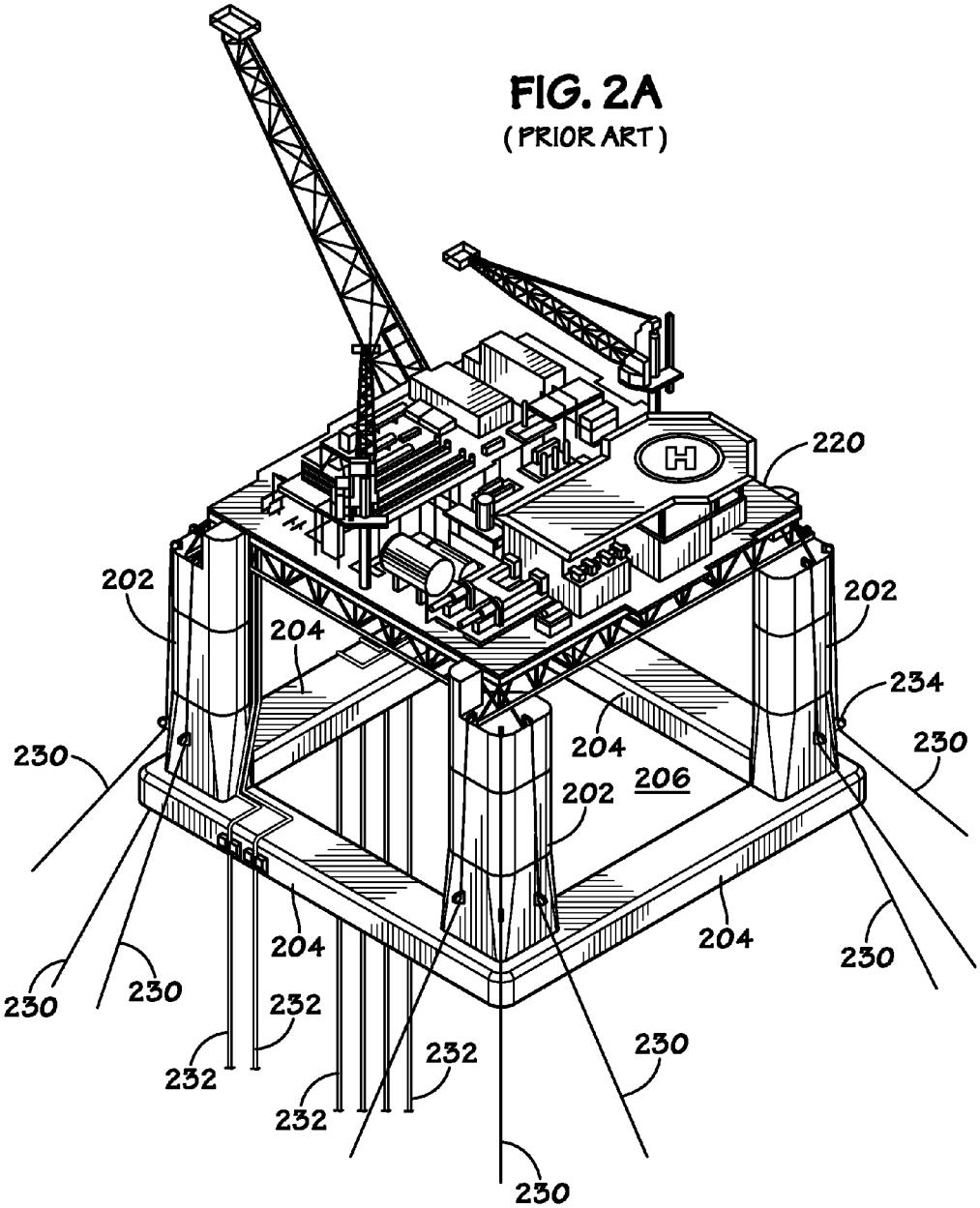
FIG. 2A (PRIOR ART)
Figure 2B:
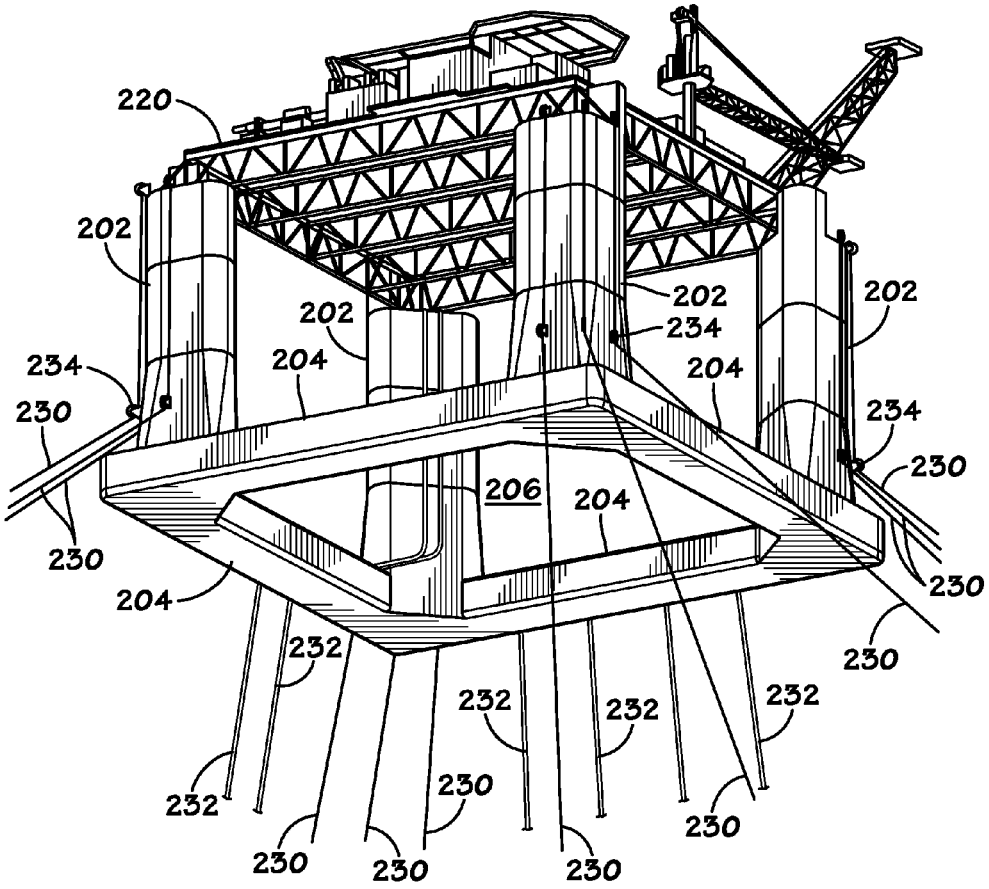
FIG. 2B (PRIOR ART)

Referring now to FIG. 3, a hull 300 of a 4-column, 4-pontoon semi-submersible according to one embodiment of the invention is equipped with 5-sided columns 302 at the corners of the vessel. It will be noted that each of the four columns 302 has five faces, four of the five faces (312, 312', 314 and 314') are perpendicular to at least one adjacent face. The fifth face 310 is the outermost face of the column. The angle between the fifth face 310 and the longitudinal axis of an adjacent pontoon 304 in the illustrated embodiment is 45 degrees. Central opening 306 in hull 300 is bounded by columns 302 and pontoons 304.

Figure 4:
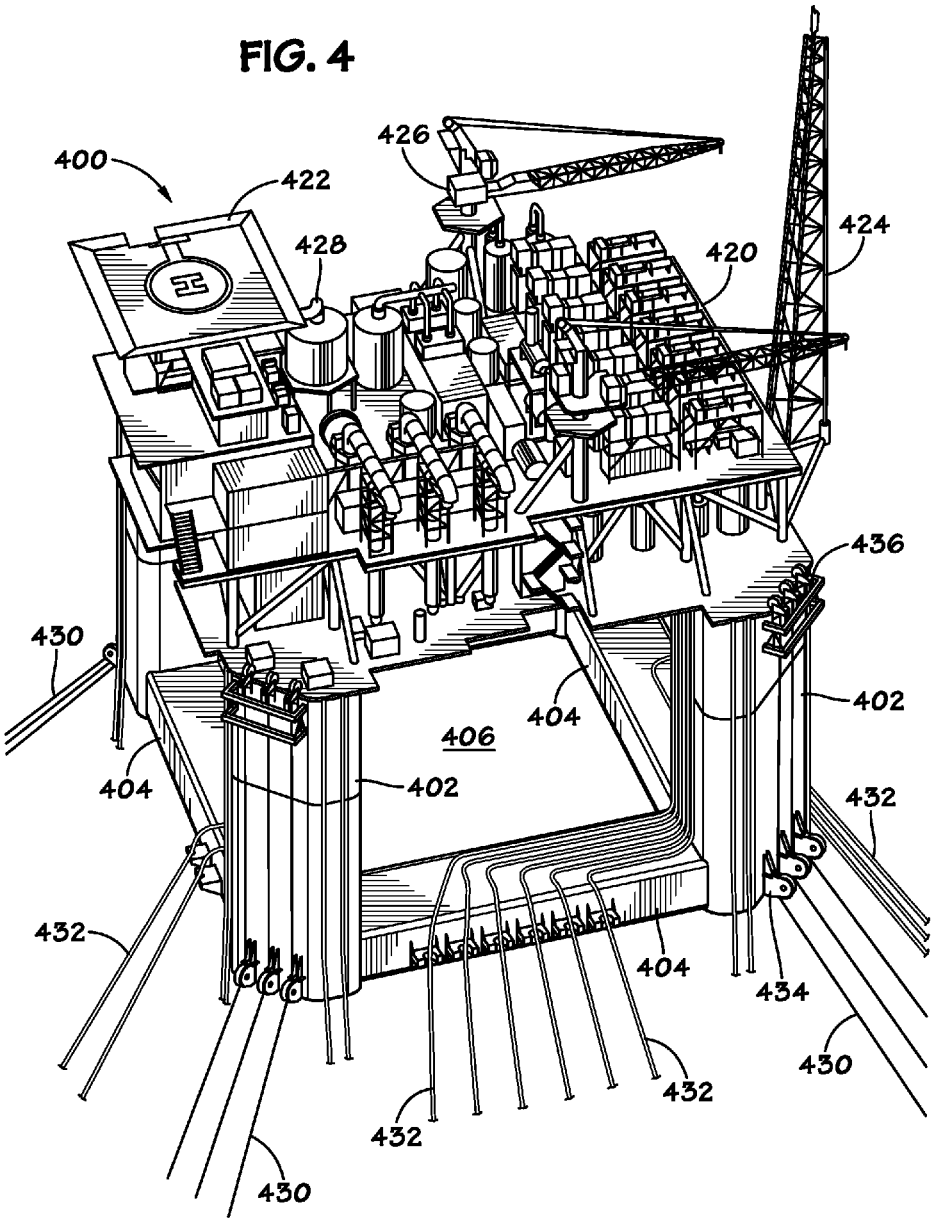
FIG. 4 is a perspective view of a semisubmersible having five-sided columns according to an embodiment of the invention.

FIG. 4 shows a semi-submersible 400 having a hull comprised of columns 402 and pontoons 404 which together define central opening 406. Semi-submersible 400 has a hull according to the form illustrated in FIG. 3. Deck 420 is supported on columns 402 and may include helipad 422, flare boom 424, crane 426 and process equipment 428. Anchor lines 430 may be routed through fairleads 434 on the outboard face of each column 402 to winches 436. The upper end of risers 432 are supported on pontoons 404.

As may be seen in FIG. 4 the corners of columns 402—i.e., the junctures of adjacent sides—may be rounded. Such rounded corners may improve the hydrodynamic properties of the vessel.

In the embodiment illustrated in FIG. 3, each of columns 302 has five sides—sides 314 and 314' are of equal length and orthogonal to each other and each is attached to an adjacent pontoon 304. Shorter sides 312 and 312' are of equal length and are orthogonal to sides 314 and 314', respectively. Fifth, outboard side 310 is joined to both sides 312 and 312' at a 45-degree angle. In the particular embodiment illustrated in FIG. 3, pontoons 304 are centered on sides 314. However, in other embodiments, the centerline of pontoon 304 may be inboard or outboard of the center of column side 314.

The ratio of the length of the diagonal that is parallel to the non-orthogonal face to the distance from the mid-point of the non-orthogonal face to the opposite corner is preferably greater than or equal to 4/3. Stated another way, the geometric center of a column's cross section should be inboard of the center of a circle which circumscribes the cross section. This configuration is illustrated graphically in FIG. 5 wherein column 502 has five sides—sides 514 and 514' are of equal length and orthogonal to each other and each may be attached to an adjacent pontoon (not shown). Shorter sides 512 and 512' are of equal length and are orthogonal to sides 514 and 514', respectively. The fifth, non-orthogonal side is joined to both sides 512 and 512' at a 45-degree angle. Preferably, the length of sides 512 is chosen such that D1/D2≥1.33

Figure 5:
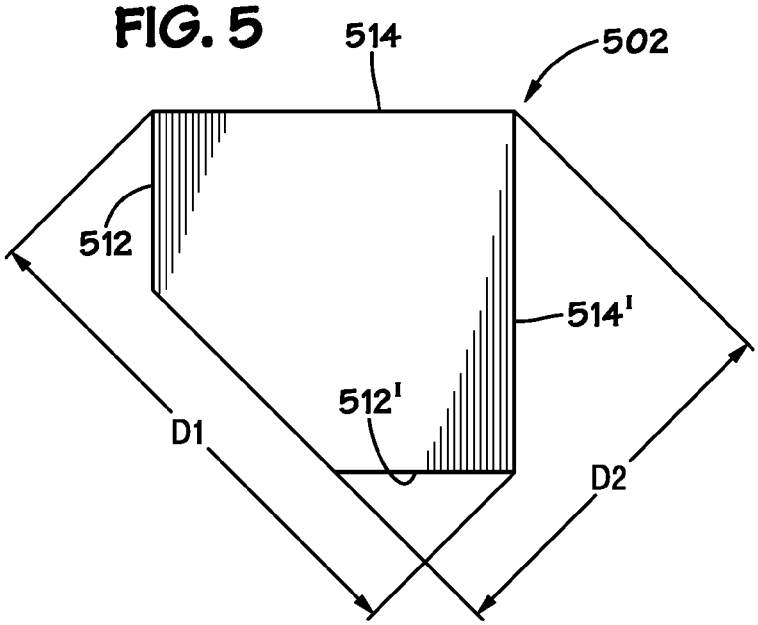
FIG. 5 is a cross-sectional view of a 5-sided semi-submersible column according to one embodiment of the invention.
Figure 6:
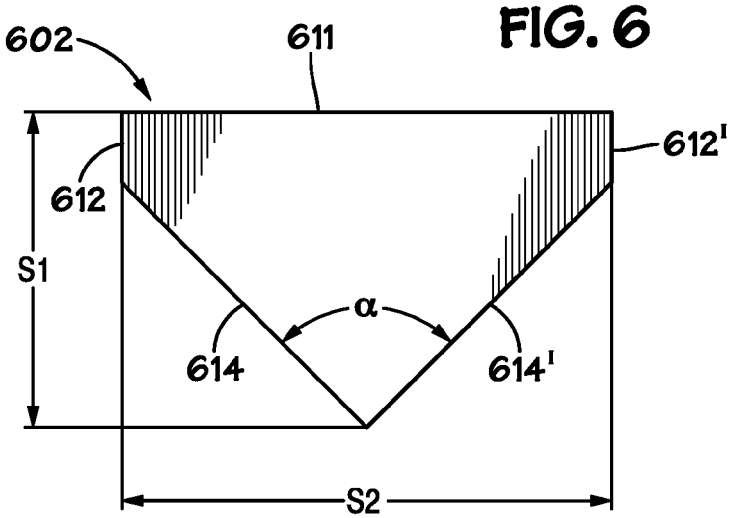
FIG. 6 is a is a cross-sectional view of a 5-sided semi-submersible column according to another embodiment of the invention.

The 5-sided column illustrated in FIG. 5 is "square" in overall planform—i.e., sides 514 and 514' are of equal length. This, however, need not be the case for each embodiment of the invention. A "rectangular" 5-sided column according to another embodiment of the invention is shown in FIG. 6. In this embodiment, S2>S1. Sides 614 and 614' are adjacent and may be used to attach column 602 to pontoons (not shown). Shorter sides 612 and 612' join sides 614 and 614', respectively to outboard side 611. In the illustrated embodiment, sides 614 and 614' are orthogonal (angle $\alpha$ is 90°) and column 602 could be used on a 4-sided semi-submersible hull. However, it will be appreciated by those skilled in the art that by varying the length of sides 612 and/or 611, angle $\alpha$ may assume a value other than 90°. For example, if column 602 were intended for use in a semi-submersible hull that was a regular pentagon in planform, the length of side 611, 612 and/or 614 may be selected such that angle $\alpha$=72°.

Figure 7:
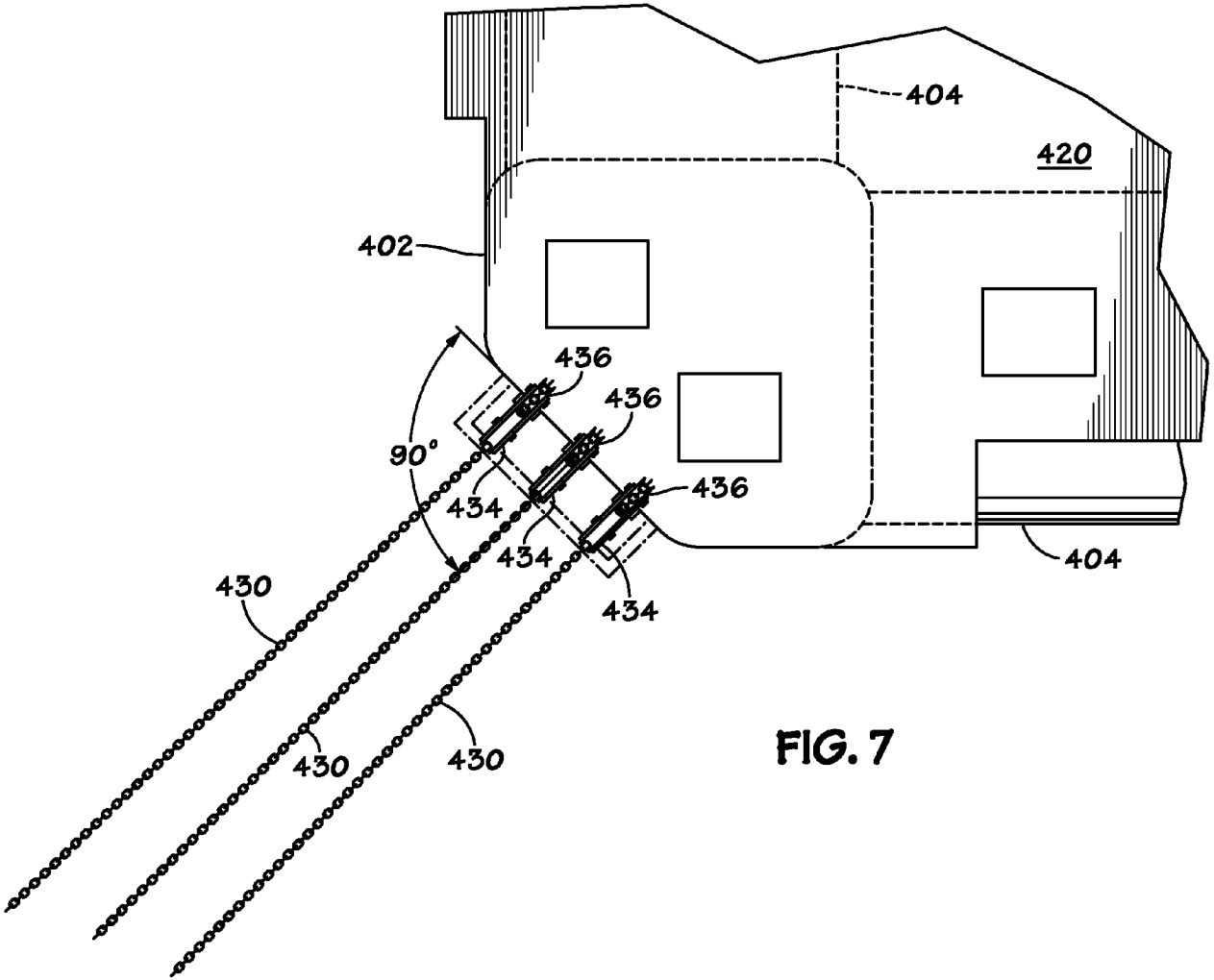
FIG. 7 is a top plan view of one corner of the semisubmersible illustrated in FIG. 4.

A semi-submersible equipped with the column form disclosed herein has at least two advantages:

- the mooring lines can connect to the hull at a right angle which allows for an easier load distribution into the column (no shear)
- The mooring chain does not have to twist between the fairlead and the windlass or chain jack which makes installation less prone to complications This feature is illustrated in the plan view of FIG. 7 wherein the 90-degree angle in planform between the middle mooring line 430 in the group of three mooring lines and the fifth, outboard-facing side of column 402 is indicated.

A column form according to the present invention may provide an advantage in the vortex-induced motion (VIM) response of the vessel.

VIM amplitudes are the highest at a current heading along the platform diagonal. VIM amplitudes are minimal when the current is perpendicular to the column face (four-faced column). A key parameter in VIM response is the projected width of the column onto a plane perpendicular to the current. Each column has the same projected width for a semi submersible having columns of rectangular cross section. A configuration according to the present invention has two distinct widths for each current heading (different from perpendicular). The different widths result in a configuration where two of the columns are in full lock-in and two columns are not in full lock-in, and thus a reduction in VIM amplitudes may be achieved.

If the aspect ratio of the column (along the diagonal) is approximately 3:4, only a 6% increase in column width is necessary to maintain the buoyancy contribution of the column (as compared to a conventional column of rectangular cross section).

A semisubmersible vessel according to the invention may comprise a plurality of pontoons arranged generally in the form of a regular polygon having n sides and a column at each vertex of the polygonal form, each column having a generally five-sided transverse cross section with at least three sides disposed at a right angle to at least one adjacent side and two adjacent sides having pontoons attached thereto disposed at an angle of 360/n degrees to one another. It will be appreciated by those skilled in the art that angle $\alpha$ in the cross-sectional view of a 5-sided semi-submersible column shown in FIG. 6 may be made equal to 360/n degrees by selection of the lengths of sides 614 and 614'.

Although the invention has been described in detail with reference to certain preferred embodiments, variations and modifications exist within the scope and spirit of the invention as described and defined in the following claims.

What is claimed is:

1. A semi-submersible vessel comprising:

four pontoons arranged in a generally rectangular form;

a column at each corner of the rectangular form, each column having a top, a bottom, and a generally five-sided transverse cross section with four sides disposed at a right angle to at least one adjacent side and a fifth side on an outboard face of the generally rectangular form disposed at 45 degrees to each adjacent side; and, at least one mooring line attached to the fifth side of each column such that the angle in planform between the mooring line and the fifth side of the column is a right angle.

2. A semi-submersible vessel as recited in claim 1 wherein a ratio of a length of a diagonal of each column's transverse cross-section that is parallel to the fifth side to a distance from a mid-point of the fifth side to a corner of the transverse cross-section directly opposite the fifth side is greater than or equal to 4/3.

3. A semi-submersible vessel as recited in claim 1 wherein the mooring line is attached to the column by a fairlead proximate the bottom of the column.

4. A semi-submersible vessel as recited in claim 1 wherein the mooring line is attached to the column by a fairlead proximate the bottom of the column and a winch proximate the top of the column.

5. A semi-submersible vessel as recited in claim 3 wherein the mooring line is routed along the fifth side of the column.

6. A semisubmersible vessel comprising:

a plurality of pontoons arranged generally in the form of a regular polygon having n sides;

a column at each corner of the polygonal form, each column having a generally five-sided transverse cross section with at least three sides of the cross section disposed at a right angle to at least one adjacent side and two adjacent sides of the column having a pontoon attached thereto disposed at an angle of 360/n degrees to a pontoon attached to an adjacent side of the column;

at least one mooring line attached to each column on a side of the column not attached to a pontoon such that the angle in planform between the mooring line and the side of the column is a right angle.

* * * * *